US006524064B2

(12) United States Patent
Chou et al.

(10) Patent No.: US 6,524,064 B2
(45) Date of Patent: Feb. 25, 2003

(54) FAN FILTER UNIT WITH SOUND-ABSORBING WEDGES

(75) Inventors: Ya-Wen Chou, Hsinchu Hsian (TW); Ming-Shan Jeng, Hsinchu Hsian (TW); Meen-Dou Hoo, Hsinchu Hsian (TW); Fang-Hei Tsau, Hsinchu Hsian (TW)

(73) Assignee: Industrial Technology Research Institute, Hsinchu Hsian (TW)

( * ) Notice: Subject to any disclaimer, the term of this patent is extended or adjusted under 35 U.S.C. 154(b) by 0 days.

(21) Appl. No.: 09/862,335

(22) Filed: May 23, 2001

(65) Prior Publication Data

US 2002/0182060 A1 Dec. 5, 2002

(51) Int. Cl.[7] ..... B01D 46/10

(52) U.S. Cl. ..... 415/119; 415/208.2

(58) Field of Search ..... 415/119, 211.2, 415/208.2, 208.1

(56) References Cited

U.S. PATENT DOCUMENTS 6,217,281 B1 * 4/2001 Jeng et al. ..... 415/119

* cited by examiner

*Primary Examiner*—Edward K. Look
*Assistant Examiner*—James M. McAleenan
(74) *Attorney, Agent, or Firm*—Rosenberg, Klein & Lee

(57) ABSTRACT

A fan filter unit includes a housing having a side wall and a top wall with a bell mouth serving as an air inlet and an open bottom to which a filtering net is attached to serve as an air outlet. A centrifugal fan is arranged in the housing to drive the air from inlet. The fan assembly has an output port for driving an air flow toward the air outlet. A guide plate is arranged in the housing for guiding the air flow along the path from the fan assembly to the air outlet. A sound-absorbing structure including a plurality of wedge-shaped elements made of a sound-absorbing material is attached to the side wall. The wedge-shaped elements are arranged in a line for effectively reducing noise level caused by the operation of the fan assembly. A second line of wedge-shaped elements is optionally attached to the side wall with the wedge-shaped elements of the two lines alternating each other.

7 Claims, 11 Drawing Sheets

FAN FILTER UNIT WITH SOUND-ABSORBING WEDGES

BACKGROUND OF THE INVENTION

1. Field of the Invention

The present invention generally relates to a fan filter unit, and in particular to a fan filter unit having sound-absorbing wedges for reducing noise caused by the operation of the fan.

2. Description of the Prior Art

Fan filter units (FFUs) are commonly incorporated in an air clean system for providing cleaned air flows to meet the severe requirement of low contamination for clean room environments. Besides operation efficiency and capability of removing contamination, an important concern of a fan filter unit the level of noise caused during the operation of the fan filter unit.

FIGS. 1 and 2 respectively show a top view and a cross-sectional view of a conventional fan filter unit. The fan filter unit comprises a housing 1 defining a bell mouth 3, serving as air inlet 11 of air flow A, and an opposite opening to which a filtering net 6 is mounted for serving as an air outlet 12 of the air flow A. A centrifugal fan assembly 2 is mounted in the housing 1 and coupled to the bell month 3. A guide plate 4 is positioned proximate the fan assembly 2 for guiding the air flow A. A baffle plate 5 is arranged between the guide plate 4 and the filtering net 6. The baffle plate 5 extends from an inside surface 13 of the housing 1 and defines an opening through which air flow passes toward the filtering net 6.

By means of the guide plate 4 and the baffle plate 5, a serpentine path of the air flow is formed inside the housing 1 which forces the air flow A to repeatedly contact the inside surface 13 of the housing 1 and the baffle 5. A sound-absorbing material is formed on the inside surface 13 of the housing 1 and the baffle plate 5 whereby the noise caused by the operation of the fan assembly 2 can be reduced due to the contact of the air flow A with the sound-absorbing material installed on the inside surface 13 of the housing 1 and the baffle plate 5.

Test and measurement show that the prominent noise caused by the fan assembly 2 occurs around the blade passage frequency of the fan assembly 2. Thus, low frequency noise around the frequency of 250–1000 Hz has a generally higher level among all the possible frequencies. However, the sound-absorbing material that is commonly employed in a fan filter unit is subject to the limitation of the configuration of the housing 1 whereby it cannot effectively reduce the low frequency noise.

Thus, it is desired to provide a low noise fan filter unit on which the noise level is effectively reduced.

SUMMARY OF THE INVENTION

Accordingly, an object of the present invention is to provide a fan filter unit having a low noise level during operation.

Another object of the present invention is to provide a fan filter unit incorporating wedge-shaped sound-absorbing elements for effectively reducing the level of noise caused by the operation of the fan.

A further object of the present invention is to provide a wedge-shaped sound-absorbing structure for a fan filter unit which effectively reduces low frequency noise level while keeping fluid flow resistance in a comparable range to the conventional configuration of the fan filter units.

To achieve the above objects, in accordance with the present invention, a fan filter unit comprises a housing having a side wall and a top wall with a bell mouth serving as an air inlet and an open bottom to which a filtering net is attached to serve as an air outlet. A centrifugal fan for driving the air from the inlet is arranged in the housing. A guide plate is arranged in the housing for guiding the air flow along the path from the fan assembly to the air outlet. A sound-absorbing structure including a plurality of wedge-shaped elements made of a sound-absorbing material is attached to the side wall. The wedge-shaped elements are arranged in a line with gaps formed between the wedge-shaped elements for effectively reducing noise level caused by the operation of the fan assembly. A second line of wedge-shaped elements is optionally attached to the side wall with the wedge-shaped elements of the two lines alternating each other.

BRIEF DESCRIPTION OF THE DRAWINGS

The present invention will be apparent to those skilled in the art by reading the following description of preferred embodiments with reference to the attached drawings, in which.

DETAILED DESCRIPTION OF THE PREFERRED EMBODIMENTS

Figure 3:
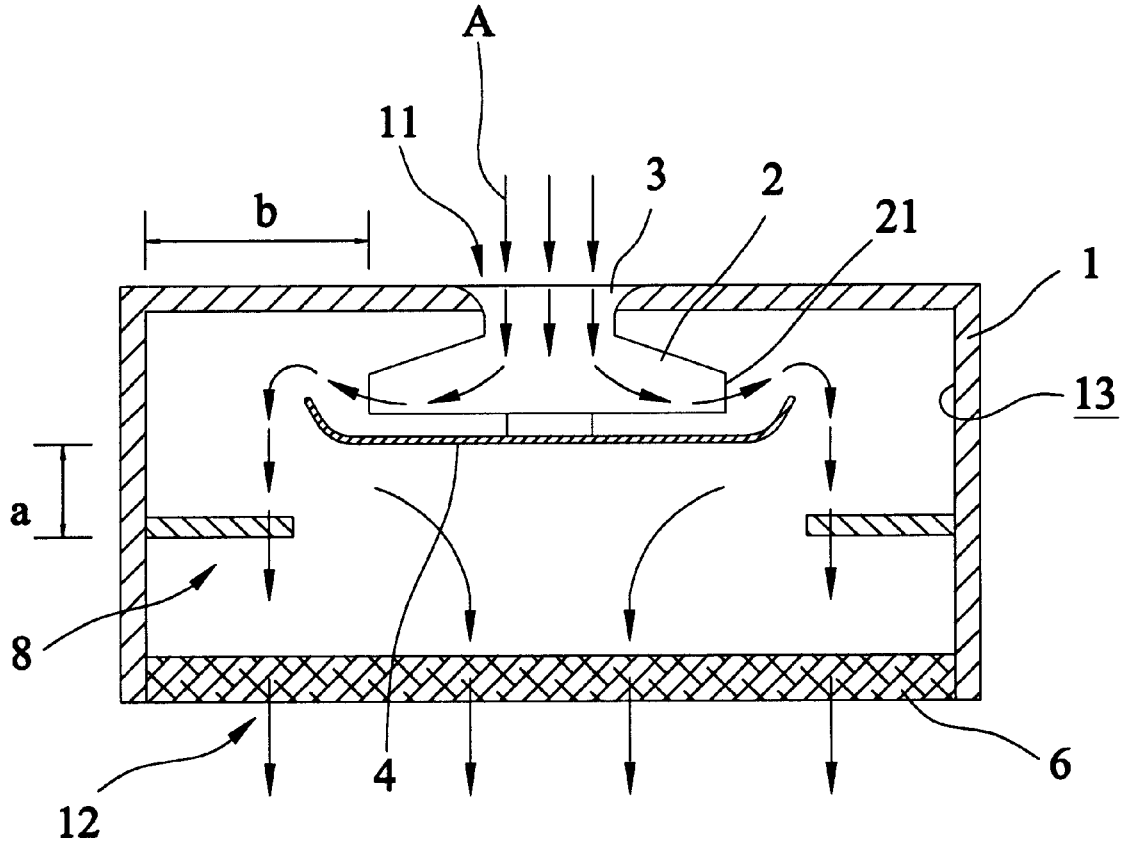
FIG. 3 is a cross-sectional view of a fan filter unit constructed in accordance with a first embodiment of the present invention.

With reference to the drawings and in particular to FIG. 3, a fan filter unit constructed in accordance with a first embodiment of the present invention is shown. The fan filter unit of the present invention comprises a housing 1 having a top wall (not labeled) defining a bell mouth 3, serving as air inlet 11, and an opposite open bottom (not labeled) to which a filtering net 6 is attached, serving as air outlet 12. A centrifugal fan assembly 2 is generally coupled to the top wall and in fluid communication with the bell mouth 3 for driving air flow A into the housing 1. A guide plate 4 is arranged in the housing 1 proximate to an outlet port 21 of the fan assembly 2 for guiding the air flow A in radial direction. Air flowing out of the fan assembly 2 via the outlet port 21 is allowed to move toward the air outlet 21 of the housing 1.

The guide plate 4 is arranged in the housing 1 whereby a serpentine path is forming for guiding air flow to move through the housing 1. The air flow moving along the serpentine path may continuously and repeatedly get into contact with inside surface of the housing 1 and the guide plate 4 and finally reaches the filtering net 6 with the contamination entrained in the air flow removed by the filtering net 6.

Figure 1:
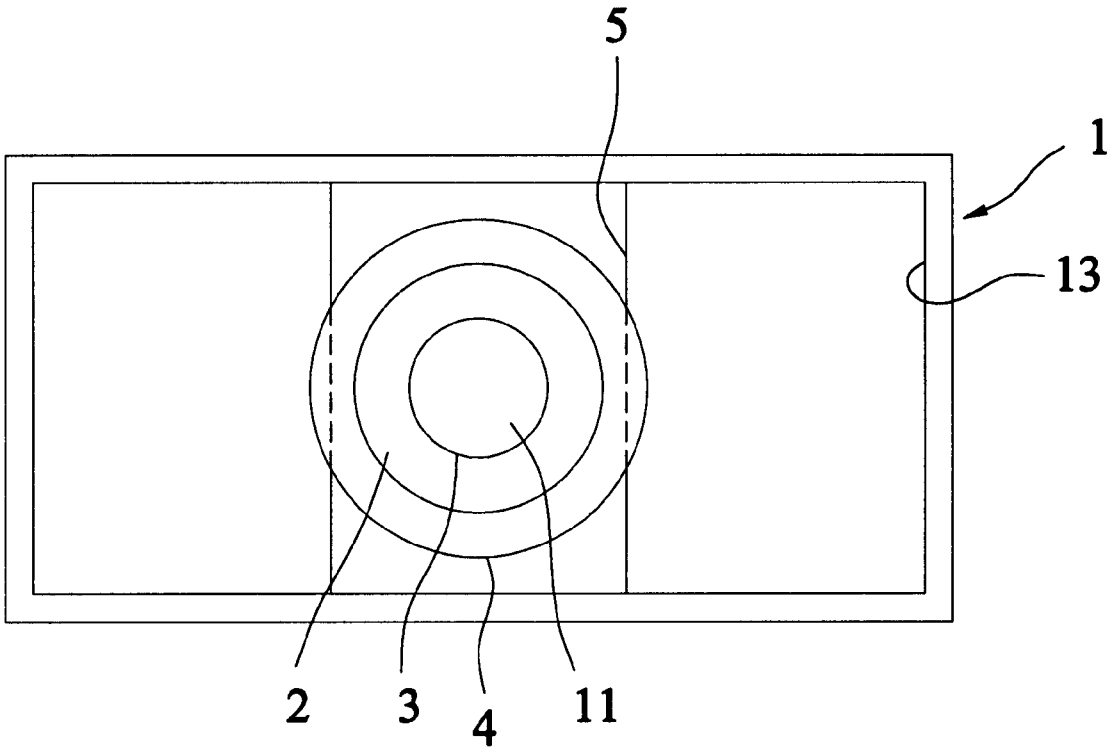
FIG.1(Prior Art)
FIG. 1 is a top view of a conventional fan filter unit.
Figure 2:
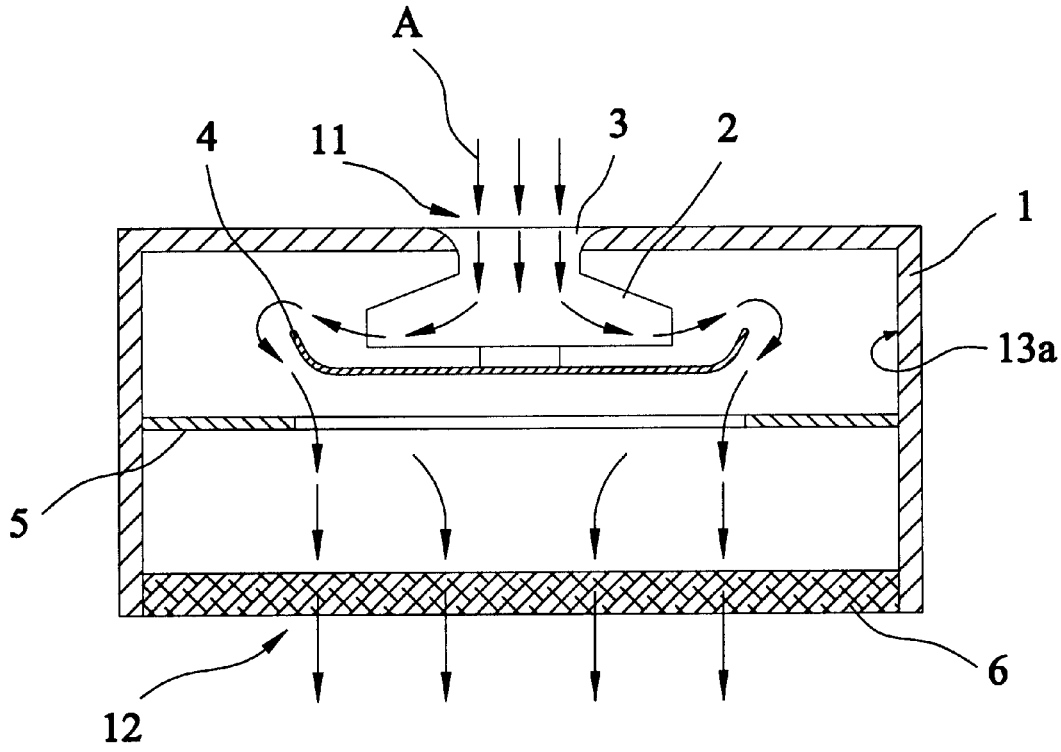
FIG.2(Prior Art)
FIG. 2 is a cross-sectional view of the conventional fan filter unit shown in FIG. 1.
Figure 4:
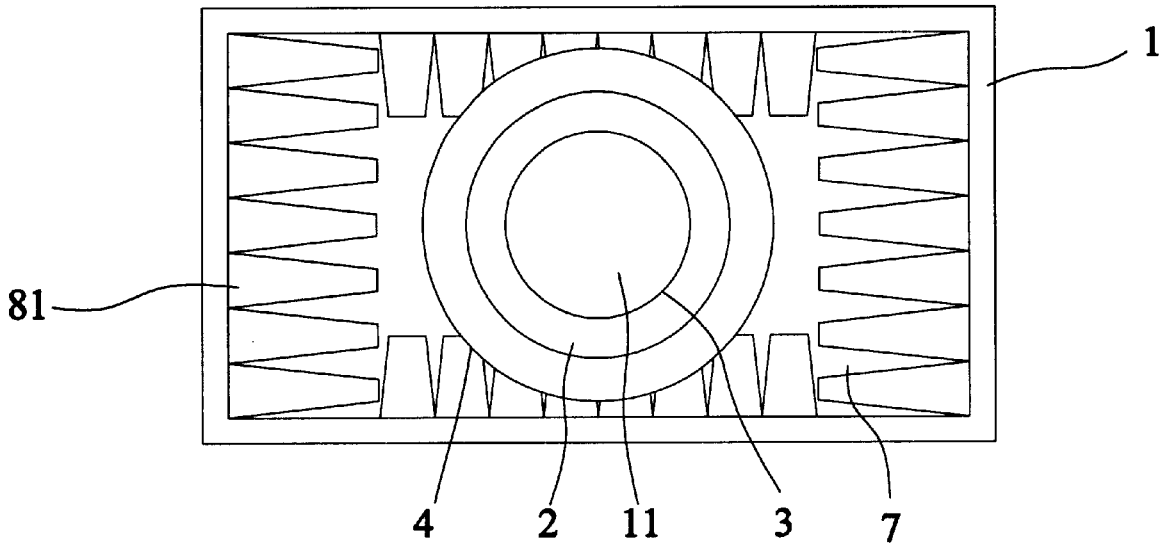
FIG. 4 is a top view of the fan filter unit of FIG. 3 with a top wall and a bottom filtering net of the fan filter unit removed.
Figure 5:
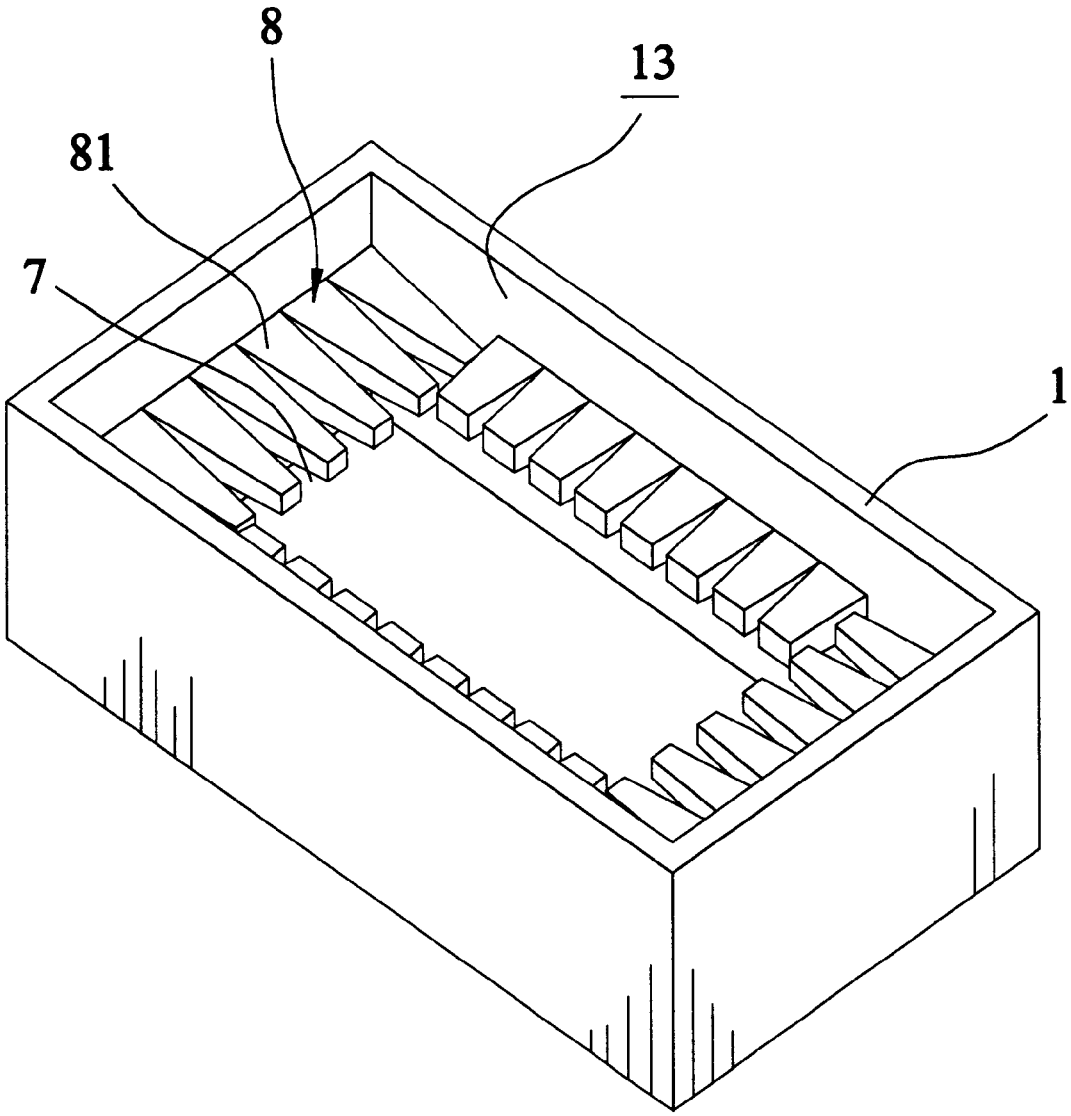
FIG. 5 is a perspective view of a housing of the fan filter unit of FIG. 3 with the top wall and the bottom filtering net removed.

Also referring to FIGS. 4 and 5, a sound-absorbing structure 8 is arranged inside the housing 1 for absorbing noise generated by the fan assembly 2. The sound-absorbing structure 8 is made of sound-absorbing materials, such as fiber glass and porous sound-absorbing foaming materials. The sound-absorbing structure 8 is attached to an inside surface 13 of the housing 1 and arranged in the way that the air flow A moves toward the filtering net 6 from the fan assembly 2 for forming serpentine paths for the air flow A. An additional advantage of the sound-absorbing structure 8 of the present invention is that, as compared to the conventional fan filter unit shown in FIGS. 1 and 2, a more uniform distribution of air flow may be obtained.

The sound-absorbing structure 8 comprises a plurality of wedge-shaped sound-absorbing elements 81 made of the above-mentioned sound-absorbing materials. Each wedge-shaped element 81 has a tapering body having a cross-sectional area reduced from a first, fixed end to a second, free end. The wedge-shaped elements 81 are attached to the inside surface 13 of the housing 1 in a line with the first ends thereof fixed to the first surface 13 as shown in FIGS. 4 and 5. A free space or gap 7 is formed between the tapering bodies of adjacent wedge-shaped elements 81.

Figure 6:
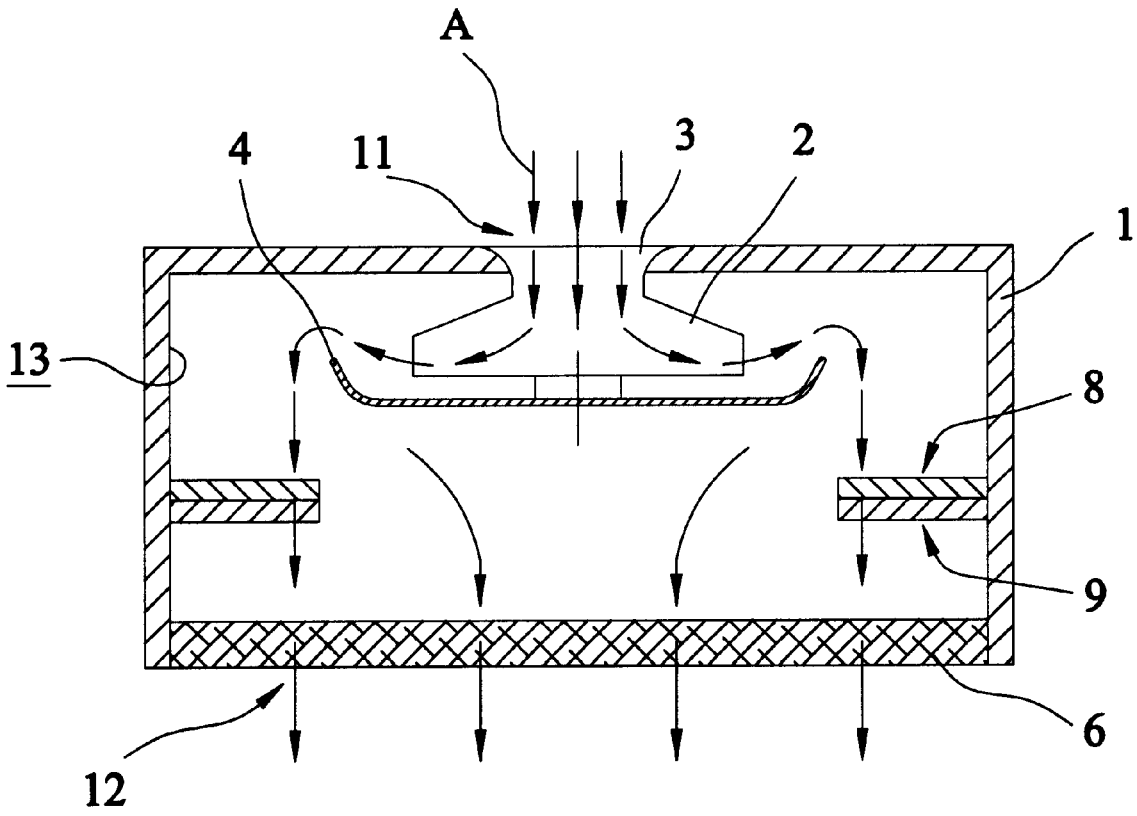
FIG. 6 is a cross-sectional view of a fan filter unit constructed in accordance with a second embodiment of the present invention.
Figure 7:
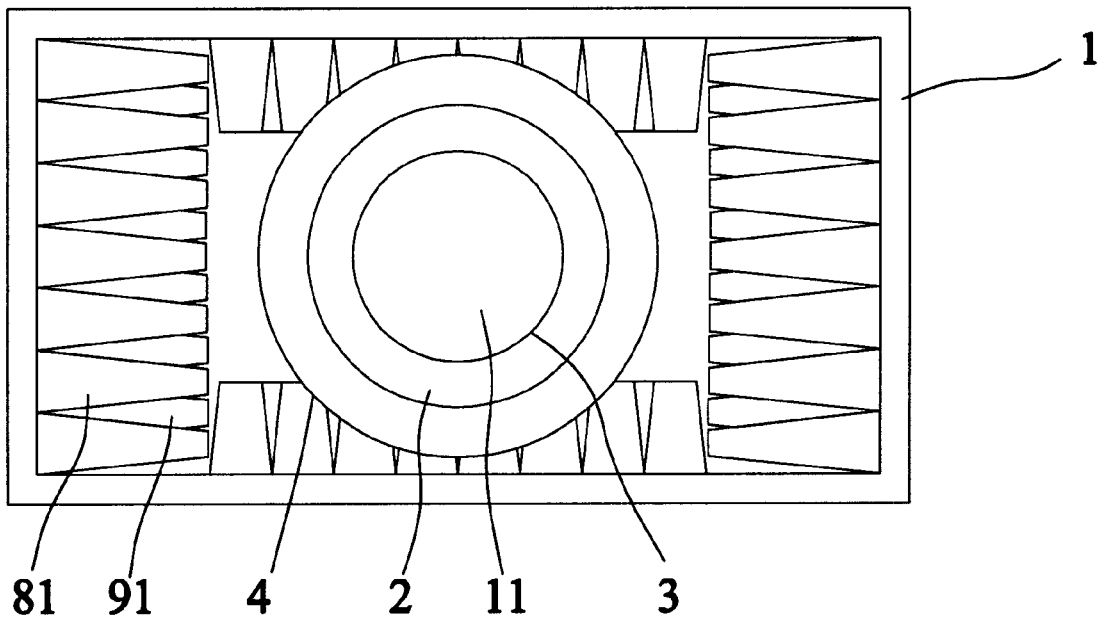
FIG. 7 is a top view of the fan filter unit of FIG. 6 with a top wall and a bottom filtering unit removed of the fan filter unit.
Figure 8:
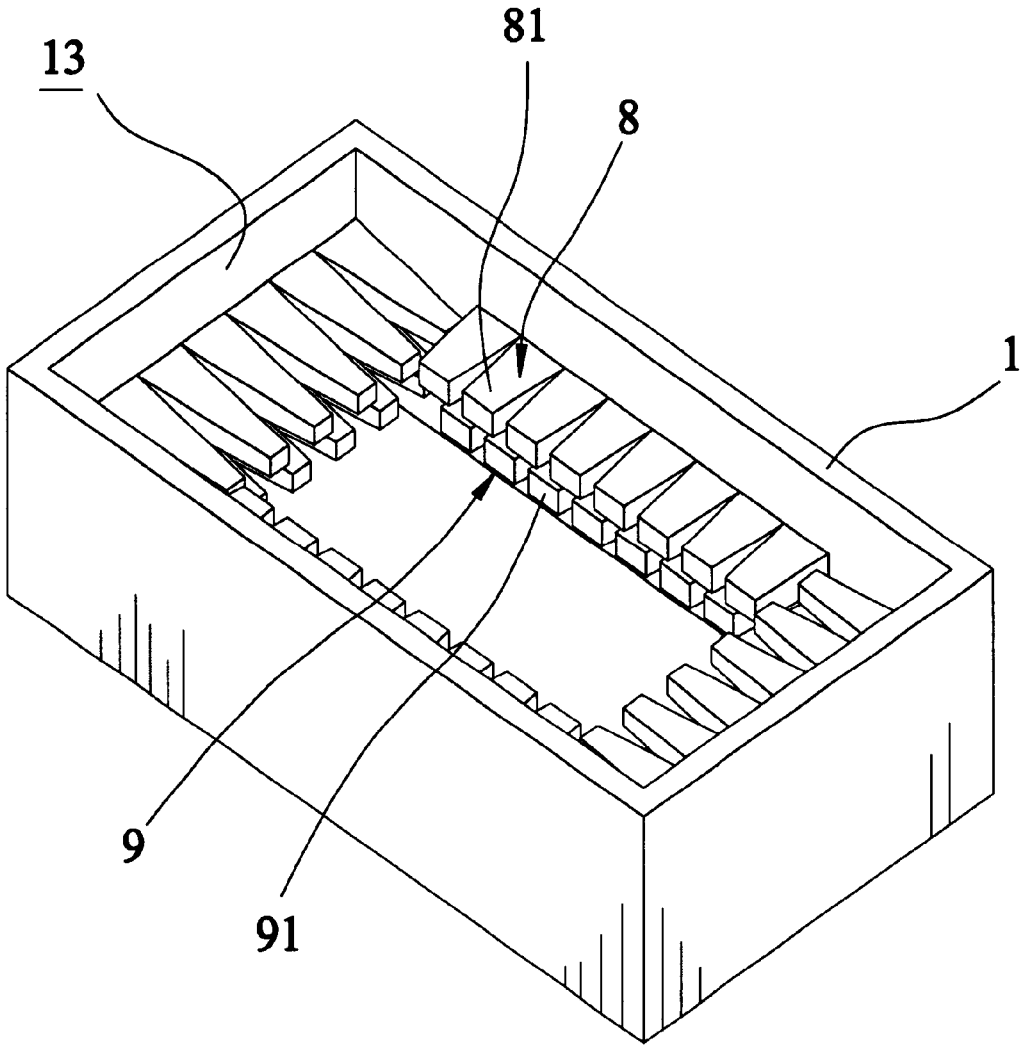
FIG. 8 is a perspective view of a housing of the fan filter unit of FIG. 6 with the top wall and the bottom filtering net removed.

Referring to FIGS. 6–8, alternatively and as a second embodiment of the present invention, two sound-absorbing structures 8, 9, each comprising a plurality of wedge-shaped elements 81, 91, are attached to the inside surface 13 of the housing 1 of the fan filter unit. The wedge-shaped elements 81, 91 are arranged in two lines inside the housing 1 with the wedge-shaped elements 81, 91 in different lines alternating each other. Due to the alternating arrangement, the gaps 7 between the elements 81, 91 of each structure 8, 9 are to some extents blocked by the elements 91, 81 of the other sound-absorbing structure 9, 8 thereby forming spaces for trapping sound waves. This enhances sound absorption.

With the wedge-shaped elements 81, 91, sound wave entrained with the air flow A enters the wedge-shaped gaps 7 between the wedge-shaped elements 81 or 91 are repeatedly reflected, allowing the energy of the noise to be substantially absorbed by the wedge-shaped sound-absorbing elements 81, 91 and thus reducing the noise level.

Figure 9:
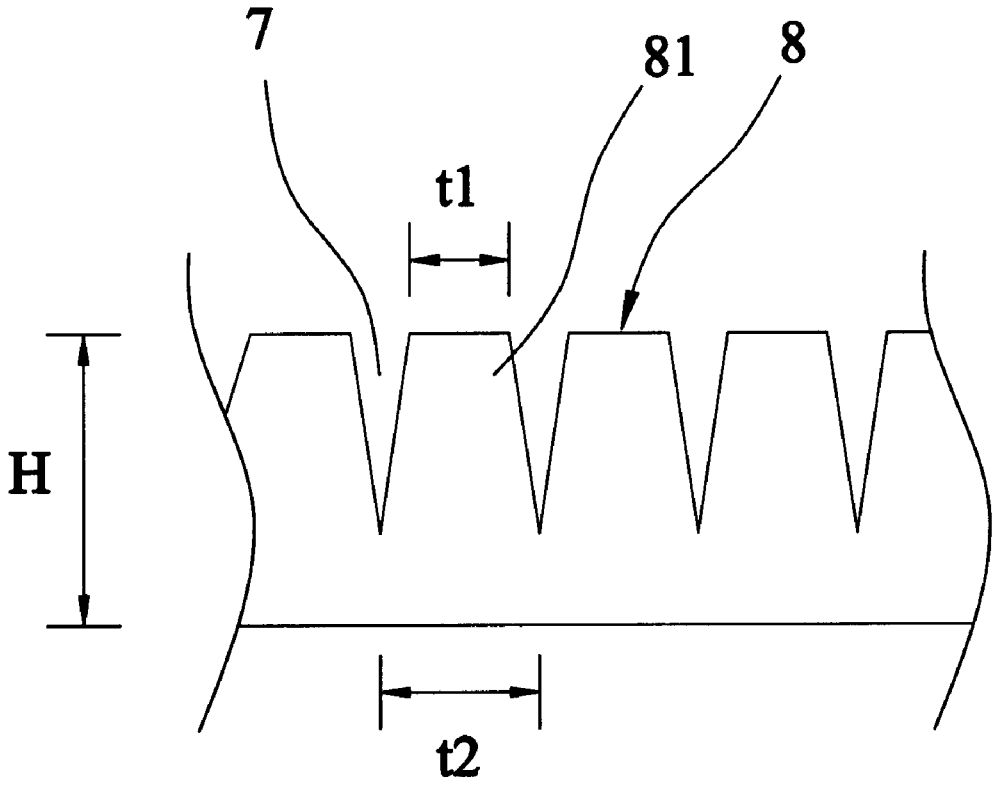
FIG. 9 is a schematic top view of a sound-absorbing structure in accordance with the present invention.

Since adding the wedge-shaped elements 81, 91 in the housing 1 increases resistance to air flow through the housing 1. To maintain proper efficiency of the fan filter unit, the dimension, quantity and arrangement of the wedge-shaped elements 81, 91 must be such that the cross-sectional area of air flow passage be maintained as compared to the prior art. Referring to FIG. 9, the height of the wedge-shaped elements 81 (91), namely the dimension between the first and second ends of the wedge-shaped elements 81 (91), is H. The width of the wedge-shaped elements 81 (91), namely the dimension in a direction parallel to the inside surface 13 of the housing 1 as viewed in the plan view, is t1 at the second end and t2 at the first end. The lowest frequency of the noise of the fan assembly 2 that can be effectively absorbed is f, which is referred to as cut-off frequency, is equal to C/(4H).

In accordance with the first embodiment illustrated in FIGS. 3–5, each wedge-shaped element 81 has a projected area as follows:

$$(t1+t2)H/2\times N=NH(t1+t2)/2$$

$$N=L/t2$$

$$NH(t1+t2)/2\leqq \text{Original surface area of the baffle plate of the conventional fan filter unit}$$

This ensures that the fan filter unit of the present invention imposes at most the same resistance to the air flow as the conventional design. In the above, N is the number of the wedge-shaped elements 81 of the sound-absorbing structure 8. L is the perimeter of the housing 1. On the other hand, the cut-off frequency satisfies the following equation:

$$f=C/4H$$

where C is sound velocity. By combining the equation, one is allowed to calculate the number (N) and the height (H) of the wedge-shaped elements 81 for effectively reducing the noise.

Referring back to FIG. 3, another design concern is that the distance a between the guide plate 4 and the sound-absorbing structure 8 is substantially equal to the distance b between the outlet port 21 of the fan assembly 2 and the inside surface 13 of the housing 1 so as to avoid sudden reduction of the cross-sectional area of the passage of the air flow. This helps minimizing pressure loss of the air flow.

Figure 10:
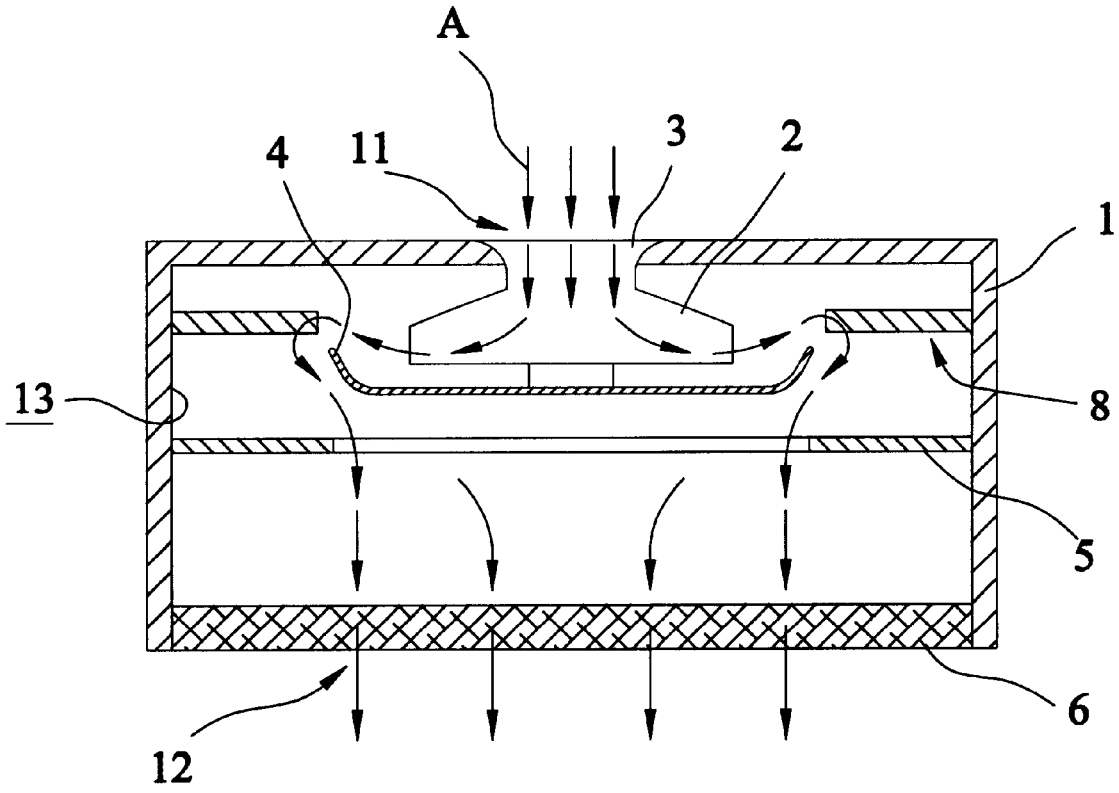
FIG. 10 is a cross-sectional view of a fan filter unit constructed in accordance with a third embodiment of the present invention.

If desired, a baffle plate 5 may be added in the fan filer unit of the present invention as illustrated in a third embodiment of the present invention shown in FIG. 10. In this case, for accommodating the baffle plate 5 inside the housing 1, the sound-absorbing structure 8 is arranged at a position on the inside surface 13 of the housing 1 corresponding the output port 21 of the fan assembly 2.

Figure 11:
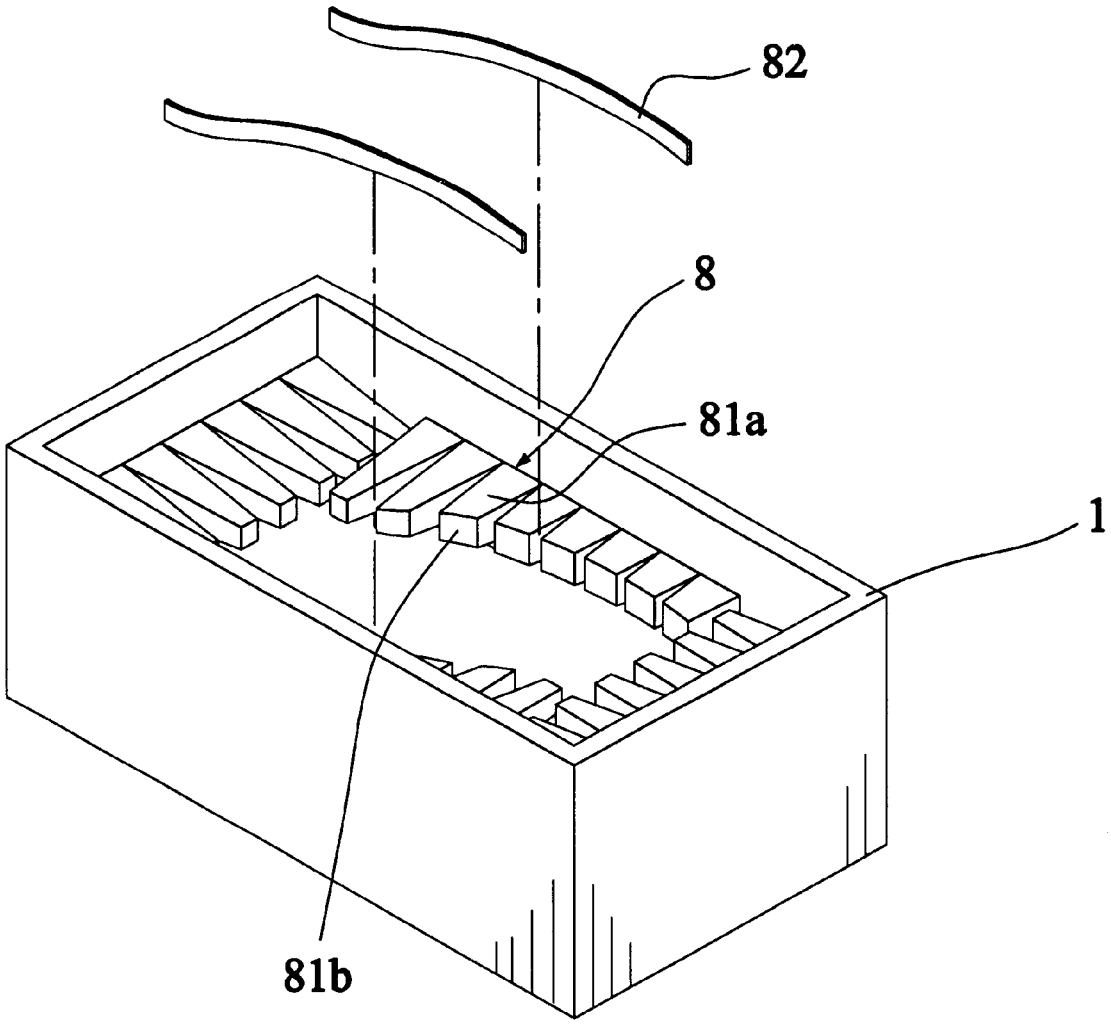
FIG. 11 is a perspective view of a housing of a fan filter unit constructed in accordance with a fourth embodiment of the present invention with a top wall and a bottom filtering net removed.

FIG. 11 shows a housing of a fan filter unit in accordance with a fourth embodiment of the present invention. The wedge-shaped elements 81 (91) of the embodiments illustrated in FIGS. 3–10 have the same dimension. However in the fourth embodiment, the wedge-shaped elements 81*a* have different height. Namely, the distance between the free end 81*b* and the fixed end of a wedge-shaped element 81*a* is different from that of a next wedge-shaped element 81*a*. In the embodiment illustrated in FIG. 11, the wedge-shaped elements 81*a* are dimensioned and arranged in such a way that the free ends form a curve trace, providing a volute air passageway for air flow leaving the centrifugal fan assembly 2. Preferably, a polyester film having a thickness around 50 $\mu$m is formed on the free end 81*b* of each wedge-shaped element 81*a*. Alternatively, a strip of sound-penetrating material 82 is attached to the free ends 81*b* of the wedge-shaped elements 81*a* for forming a continuous surface.

Although the present invention has been described with reference to the preferred embodiments thereof, it is apparent to those skilled in the art that a variety of modifications and changes may be made without departing from the scope of the present invention which is intended to be defined by the appended claims.

We claim:

1. A fan filter unit for drawing in an untreated air flow and providing a cleaned air flow, comprising:

a housing having a side wall and defining an air inlet and an air outlet;

a fan assembly arranged in the housing and in fluid communication with the air inlet for drawing in the untreated air flow, the fan assembly having an output port for driving the air flow into the housing;

a filtering net attached to the air outlet of the housing for filtering and thus cleaning the air flow;

a guide plate arranged in the housing for guiding the air flow along a serpentine path from the output port of the fan assembly to the air outlet; and a first sound-absorbing structure comprising a plurality of first wedge-shaped elements made of a sound-absorbing material and a second sound-absorbing structure made of a sound-absorbing material comprising a plurality of second wedge-shaped elements, the first and second sound-absorbing structures being fixed inside the housing in the path of the air flow from the fan assembly to the air outlet, the first wedge-shaped elements being arranged in a first line and the second wedge-shaped elements being arranged in a second line substantially parallel to the first line, the second wedge-shaped elements alternating in position with respect to the first wedge-shaped elements.

2. The fan filter unit as claimed in claim 1, wherein the sound-absorbing structure is arranged at a first distance from the guide plate, while the output port of the fan assembly is spaced from the side wall a second distance, the second distance being substantially the same as the first distance.

3. The fan filter unit as claimed in claim 1, wherein the sound-absorbing structure is attached to the side wall at a position facing the output port of the fan assembly.

4. The fan filter unit as claimed in claim 3, further comprising a baffle plate fixed in the housing between the sound-absorbing structure and the air outlet.

5. The fan filter unit as claimed in claim 1, wherein the wedge-shaped elements are dimensioned and arranged so that free ends of the wedge-shaped elements form a curve trace defining a volute air passageway.

6. The fan filter unit as claimed in claim 5 further comprising a strip of sound-penetrating material attached to the free ends of the wedge-shaped elements to form a continuous surface.

7. A fan filter unit for drawing in an untreated air flow and providing a cleaned air flow, comprising:

a housing having a side wall and defining an air inlet and an air outlet;

a fan assembly arranged in the housing and in fluid communication with the air inlet for drawing in the untreated air flow, the fan assembly having an output port for driving the air flow into the housing;

a filtering net attached to the air outlet of the housing for filtering and thus cleaning the air flow;

a guide plate arranged in the housing for guiding the air flow along a serpentine path from the output port of the fan assembly to the air outlet;

at least a sound-absorbing structure comprising a plurality of wedge-shaped elements made of a sound-absorbing material, the sound-absorbing structure being fixed inside the housing in the path of the air flow from the fan assembly to the air outlet, the wedge-shaped elements being dimensioned and arranged so that free ends of the wedge-shaped elements form an arcuate contour defining a volute air passageway; and, a thin film of polyester with a thickness of 50 $\mu$m attached to the free end of at least one wedge-shaped element.

* * * * *